United States Patent [19]

Wolfe

[11] 4,303,243

[45] Dec. 1, 1981

[54] SYSTEM AND METHOD OF TIMING GOLFERS ON A GOLF COURSE

[76] Inventor: Noah T. Wolfe, 8405 Slant Oak Dr., Round Rock, Tex. 78664

[21] Appl. No.: 160,348

[22] Filed: Jun. 17, 1980

[51] Int. Cl.[3] ..... A63B 69/36

[52] U.S. Cl. ..... 273/176 R; 368/77

[58] Field of Search ..... 368/77, 3; 273/32 R, 273/176 R, 176 L

[56] References Cited

U.S. PATENT DOCUMENTS

| | | | |
|---|---|---|---|
| 1,572,097 | 2/1926 | Walters | 368/77 |
| 3,478,452 | 11/1969 | Bidwell et al. | 273/176 L X |
| 3,545,199 | 12/1970 | Rice | 368/77 X |

*Primary Examiner*—George J. Marlo

*Attorney, Agent, or Firm*—Fulbright & Jaworski

[57] ABSTRACT

A system and method for timing the play of golfers on a golf course having a plurality of golf holes. A timer is positioned at selected intervals on the golf course. Each timer is set back in time relative to its preceding timer in an amount equal to a predetermined playing time between each timer and its preceding timer. Each timer includes an assigned mark for each group of golfers which moves relative to a timing indicator for indicating the speed of play of each group of golfers between each timer and the preceding timer. Preferably the timers are positioned at each tee of the golf course. The timing indicator shows whether the golfers play the preceding interval faster, slower, or equal to the predetermined playing time.

5 Claims, 2 Drawing Figures

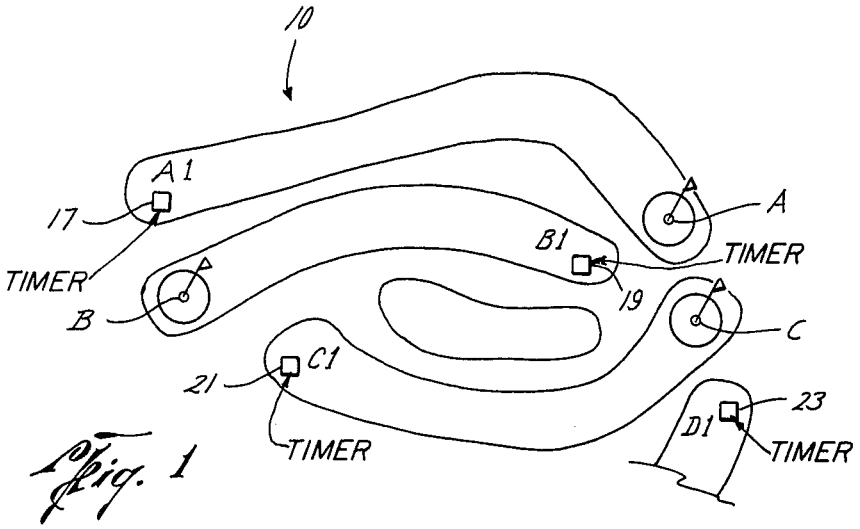
Fig. 1
Fig. 2
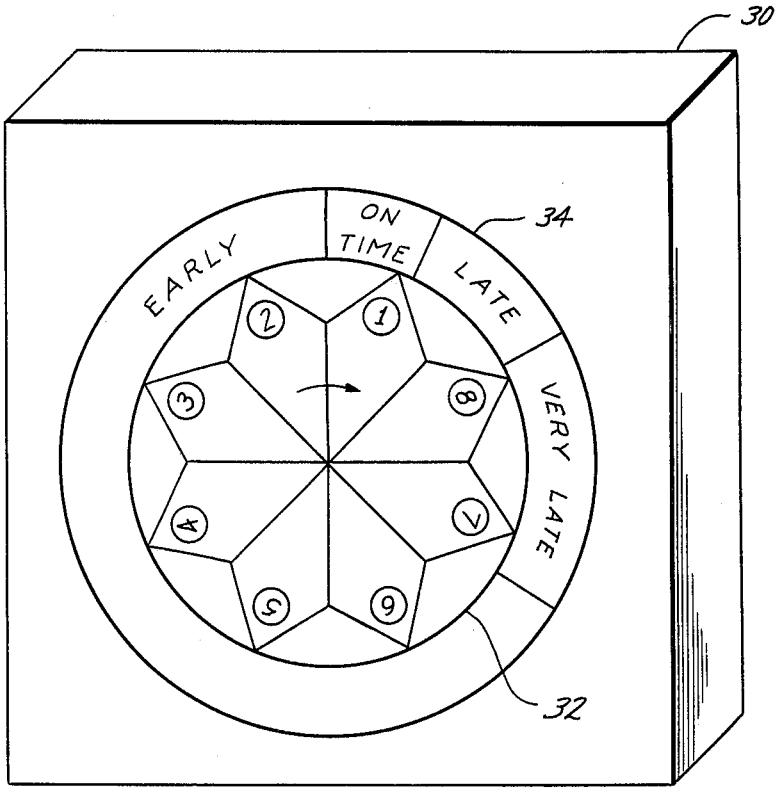

SYSTEM AND METHOD OF TIMING GOLFERS ON A GOLF COURSE

BACKGROUND OF THE INVENTION

It is well known that golf courses today are crowded and the slow play of some groups of golfers increases the congestion on the course and interferes with all of the players playing behind them. The slow players, who may not even recognize that they are playing slow, create congestion on the golf course and prevent optimum utilization of the course for other players.

The present invention is directed to a system and method to be used on golf courses to make the players aware of the time of their play and assist in helping speed up slow play and keep groups of golfers moving at a steady pace.

SUMMARY

The present invention is directed to a system and method for timing the play of golfers and indicating to the golfers their time of play on a golf course having a plurality of golf holes. A timer is positioned at selected positions and intervals on the golf course. Each timer is set back in time relative to its preceding timer an amount equal to a predetermined playing time between each timer and its preceding timer. Each timer includes an assigned mark for each group of golfers which moves relative to a timing indicator. Thus, the timer will indicate the speed of play of each group of golfers between each timer and the preceding timer.

A further object of the present invention is the provision of positioning the timers at each tee on the golf course.

A still further object of the present invention is wherein the assigned marks for each group of golfers are equally spaced on the timer for indicating whether the groups of golfers are starting and playing at the proper speed at the proper time.

A still further object is the provision wherein the timing indicator shows whether the golfers play the preceding intervals faster, slower, or equal to the predetermined playing time.

Yet a further object is the provision of a golf timer for use at selected intervals on a golf course for timing the play of golfers in which the timer includes a plurality of assigned marks equally spaced for indicating a plurality of groups of golfers, a timing indicator for indicating the speed of play of each group of golfers on their last interval of play and means for moving the assigned marks relative to the timing indicator.

Other and further objects, features and advantages will be apparent from the following description of a presently preferred embodiment of the invention, given for the purpose of disclosure and taken in conjunction with the accompanying drawing.

BRIEF DESCRIPTION OF THE DRAWING

FIG. 1 is a schematic diagram of a portion of a golf course showing the preferred location of the timers of the present invention, and FIG. 2 is an elevational view illustrating the face of the timer for providing an indication to the golfers of their proper starting times and speed of play.

DESCRIPTION OF THE PREFERRED EMBODIMENT

Referring now to FIG. 1, a schematic view of a portion of a golf course is shown, generally indicated by the reference numeral 10 having a first hole A, a second hole B, a third hole C. The holes A, B and C have a tee area A1, B1 and C1, respectively. Tee area D1 for hole D (not shown) is also shown.

The present invention consists of a plurality of identical timers 30 (FIG. 2) positioned at selected positions and intervals on the golf course 10. Preferably, a timer will be provided for each of the holes and preferably placed on each tee. Thus, timer 30 will be placed at position 17 on tee A1, a timer 30 will be positioned at position 19 on tee B1, a timer 30 will be located at position 21 on tee C1, and a timer 30 will be located at a position 23 on tee D1. If desired, more or less timers could be used and placed at any location on the golf course 10.

Referring now to FIG. 2, each timer 30 may include a conventional clock mechanism, a disc 32 having a plurality of assigned marks, for example only, 1 through 8 and a timing indicator 34. The disc 32 rotates relative to the timing indicator 34, and preferably the indicator 34 is stationary and the disc 32 rotates. The timer 30 may include any suitable clock mechanism such as a standard battery operated clock in which the disc 32 is mounted in place of the minute hand and therefore rotates one complete revolution per hour.

The assigned marks 1 through 8 are sequentially numbered counterclockwise on the disc 32 and equally spaced to indicate how many groups of golfers will start for each rotation of the disc 32, that is, for example, each hour. Thus for the example shown with eight assigned marks, eight groups of golfers will start play each hour at regular $7\frac{1}{2}$ minute intervals. Of course, for other golf courses, the spacing and number of starting groups per hour may vary.

The timing indicator 34 may have suitable legends for indicating both starting times and indicating the speed of play of each group of golfers. For example, the timing indicator may be marked "EARLY", "ON TIME", "LATE", and "VERY LATE", or any suitable designation.

For starting various groups of golfers, each group would be assigned a number corresponding to assigned marks 1 through 8 on the disc 32. Assuming that the first group is starting on the hour and would be assigned the mark 1, the timer 30 at position 17 on tee A1 of the first hole A would be set so that the assigned mark 1 on the rotating disc 32 reaches the "ON TIME" area of the timing indicator 34 on the hour. This indicates to the first group to commence play. The second group would be assigned the mark number 2 and commence play at A1 when the number 2 mark reaches the "ON TIME" area on the timing indicator 34. The starting sequence would continue through number 8 and start over again with number 1. Thus the timer provides an indication to the golfers when to start and visually impresses upon them the need to be punctual.

Each of the holes such as A, B and C on the course would be assigned a predetermined ideal playing time. Such a predetermined time would be a sufficient time allowance so that a normal golfer would be able to complete the hole in the time allowance without difficulty. Each succeeding timer 30 is set back in time relative to its preceding timer 30 on the preceding hole an amount equal to a predetermined playing time between each timer and its preceding timer. Assuming that the predetermined playing time for the first hole A is fifteen minutes, then the timer 30 at location 19 on the tee B1 of the second hole would be set fifteen minutes behind the timer 30 at location 17 on the tee A1 of the first hole A. Similarly, if the predetermined playing time for the second hole is twelve minutes, the timer 30 positioned at location 21 on the tee C1 of the third hole C is set twelve minutes later than the timer at position 19. Thus, if the group assigned a mark, such as number 1, plays the first hole in fifteen minutes, they will arrive at tee B1 as the timer at location 19 indicates that the assigned mark number 1 is at the "ON TIME" location on the timing indicator 34. Similarly, if they play the second hole 12 in twelve minutes, they will arrive at the third tee C1 as the timer 30 at location 21 again indicates that assigned mark number 1 is located at "ON TIME".

On the other hand, if the group assigned mark number 1 takes more than the predetermined time on any hole their indicator number 1 on the disc 32 on the next timer 30 will be past the "ON TIME" area and they will know that they should play faster to catch up with the next timer 30 on the next hole. As each succeeding group arrives at the timers 30 they will be able to check their assigned mark 2 through 8 relative to the timing indicator 34 to visually observe if they are playing at the proper speed.

The present system of timers 30 positioned at selected intervals on the golf course and properly set to time a predetermined playing time for the preceding interval will keep the golf players informed of how fast they are playing, and provide a visual incentive to maintain a proper playing speed. Of course, if necessary, officials can use the system in controlling play in requiring groups that do not keep up with the timers to allow following groups to play through, or to skip a hole and move ahead, or even leave the course.

The present invention, therefore, is well adapted to carry out the objects and attain the ends and advantages mentioned as well as others inherent therein. While a presently preferred embodiment of the invention has been given for the purpose of disclosure, numerous changes in the detail of construction and arrangement of parts and steps of the method will be readily apparent to those skilled in the art and which are encompassed within the spirit of the invention and the scope of the appended claims.

What is claimed is:

1. A golf course including a system for timing play of golfers comprising, a timer positioned at selected locations on consecutive holes of the golf course, each consecutive timer being set back in time relative to its preceding timer an amount equal to a predetermined group playing time between each timer and its preceding timer, each timer having an assigned mark for each group of golfers and each timer having an indicator moving relative to the assigned marks for indicating at each of said selected locations whether the group of golfers arrived early, late or on time relative to the predetermined playing time from the preceding timer.

2. The system of claim 1 wherein the timers are positioned at each tee of the course.

3. The system of claim 1 wherein each timer timing indicator indicates whether the golfers played the preceding interval faster or slower than the predetermined playing time.

4. The system of claim 1 wherein the assigned marks for each group of golfers are equally spaced on the timer.

5. A method of timing play of golfers on a golf course having a plurality of golf holes comprising, placing a timer at a plurality of locations on consecutive holes on the golf course in which each timer includes a plurality of assigned marks for different groups of golfers, and an indicator moving relative to the assigned marks for indicating at each of said selected locations whether the group of golfers arrived early, late or on time relative to a predetermined playing time from the preceding timer, setting each timer back in time relative to its preceding timer an amount equal to the predetermined playing time between each timer and its preceding timer, and assigning a different mark for different groups of golfers whereby each group of golfers may compare their assigned mark to each selected location with the indicator for indicating whether the group of golfers arrived at the selected location early, late or on time relative to the predetermined playing time from the preceding timer.

* * * * *